United States Patent [19]

Owens

[11] Patent Number: 4,591,291

[45] Date of Patent: May 27, 1986

[54] USER-MOUNTED CONCRETE SCREED

[76] Inventor: Joe M. Owens, 842 Lake Holiday Dr., Sandwich, Ill. 60548

[21] Appl. No.: 690,733

[22] Filed: Jan. 11, 1985

[51] Int. Cl.[4] ..... E01C 19/22

[52] U.S. Cl. ..... 404/118; 404/120; 404/97; 404/114; 15/235.4; 425/456

[58] Field of Search ..... 404/118, 119, 120, 96, 404/114, 106, 102, 99, 97; 172/41, 611, 790; 30/198, 296 R; 52/749; 173/30; 425/456; 111/52; 182/142; 248/364, 292.1; 15/235.4; 37/1

[56] References Cited

U.S. PATENT DOCUMENTS

| | | | |
|---|---|---|---|
| 3,067,656 | 12/1962 | Gustafsson | 404/118 X |
| 3,327,788 | 6/1967 | Kolpe | 172/41 X |
| 4,179,805 | 12/1979 | Yamada | 172/41 X |
| 4,359,296 | 11/1982 | Cronkhite | 404/114 |
| 4,449,845 | 5/1984 | Carrillo | 404/118 |

FOREIGN PATENT DOCUMENTS

| | | | |
|---|---|---|---|
| 42402 | 11/1965 | Fed. Rep. of Germany | 404/118 |

*Primary Examiner*—James A. Leppink
*Assistant Examiner*—Matthew Smith
*Attorney, Agent, or Firm*—Lee, Smith & Zickert

[57] ABSTRACT

A portable screed for working concrete and which is mounted on the user. The screed includes a variable length screed plate, a vibrator for the screed plate, a frame attached to the screed plate, a body harness connected intermediate the ends of the frame, and a balancing weight positioned so that the center of gravity of the screed is essentially coextensive with the center of gravity of the operator. The body harness is adjustable along the frame, and the frame may be adjustable as required to ensure that the center of gravity of the frame is positioned coextensively with the center of gravity of the operator so that the operator is not unbalanced by the screed.

16 Claims, 12 Drawing Figures

USER-MOUNTED CONCRETE SCREED

BACKGROUND OF THE INVENTION

This invention relates to concrete screeds and in particular to a portable screed which may be mounted on an operator and guided by the operator to smooth freshly-poured concrete prior to curing.

Smoothing and leveling of freshy-poured concrete is done in essentially two manners. First, in a semi-automated manner, concrete screeds such as that described in my U.S. Pat. No. 4,340,351 are used. However, such screeds can be relatively expensive and normally are used for relatively wide expanses of concrete. Second, the typical manual leveling of concrete can be employed where two laborers position themselves on either end of a board and simply smooth the concrete by moving the board along the surface of the fresh concrete. Such a process is awkward, slow and labor-intensive. In addition, because the board is not vibrated, voids can occur in the concrete, leading to weakened areas subject to later crackling or spalling. U.S. Pat. No. 4,359,296 discloses a vibrator for such screed boards, thus providing a means to vibrate the screed board, but still requiring two laborers, one on either end of the screed board, in order to smooth the fresh concrete.

SUMMARY OF THE INVENTION

The present invention combines both the speed and efficiency of a complex vibratory concrete screed with the small size and portability of a screed board to provide a portable screed for working concrete which is mounted on and carried by an operator while he moves the screed across freshly-poured concrete. The screed includes a screed plate for working the concrete and means to impart vibrations to the screed plate for tamping and leveling of the freshly-poured concrete. An elongated frame is connected at one end to the screed plate and a body harness is connected to the frame intermediate the ends thereof. Balancing means is connected on the frame for positioning the center of gravity of the screed in the vicinity of the connection of the harness to the frame, and therefore substantially coextensive with the center of gravity of the operator of the screed.

In accordance with the disclosed embodiments of the invention, the vibrating means comprises a vibrator which is secured to the screed plate. In order to reduce the size and weight of the vibrator to a minimum, an electrical vibrator is chosen, such as that disclosed in U.S. Pat. Nos. 4,359,296 or 4,073,593.

The frame comprises a pair of spaced, parallel tubes connected at one end to the screed plate. A cross brace is located between the tubes and an operator's handle is connected to the cross brace within reach of the operator so that the operator can apply pressure or lift and translate the screed, as desired. For ease of operation, a switch for controlling the vibrator is located on the handle.

The tubes of the frame may be adjustable in length. Each of the tubes includes a joint and a connector spanning the joint. The connector has a plurality of attachment positions and bolts are provided for securing the connector to each tube at the joint.

The body harness includes a waist belt and, if needed, shoulder straps to pass over the shoulders of the operator. To connect the frame to the body harness, a sleeve is mounted on and slideable along each tube and a pivot pin extends between the sleeve and the waist belt. Each sleeve is releasably secured to its respective tube so that the balance of the screed can be finely adjusted.

Sufficient weight is attached to the frame opposite from the screed plate so that the screed is essentially balanced on the operator. Fine adjustment of the balance is, as noted above, by means of the adjustment of the sleeves of the harness along the tubes of the frame.

The invention is particularly useful in smoothing fairly narrow ribbons of concrete, such as sidewalks, driveways and the like. Because obstacles may be encountered on opposite sides of the ribbon of concrete, the frame is releasably connected to the screed plate so that a variety of varying length screed plates may be used. A keyway is provided in the frame and a corresponding key is located on each screed plate so that the frame can be securely fastened to the screed, but at the same time be readily releasable therefrom.

BRIEF DESCRIPTION OF THE DRAWINGS

The invention is described in greater detail in the following description of examples emboding the best mode of the invention, taken in conjunction with the drawings, in which.

DESCRIPTION OF EXAMPLES EMBODYING BEST MODE OF THE INVENTION

Figure 1:
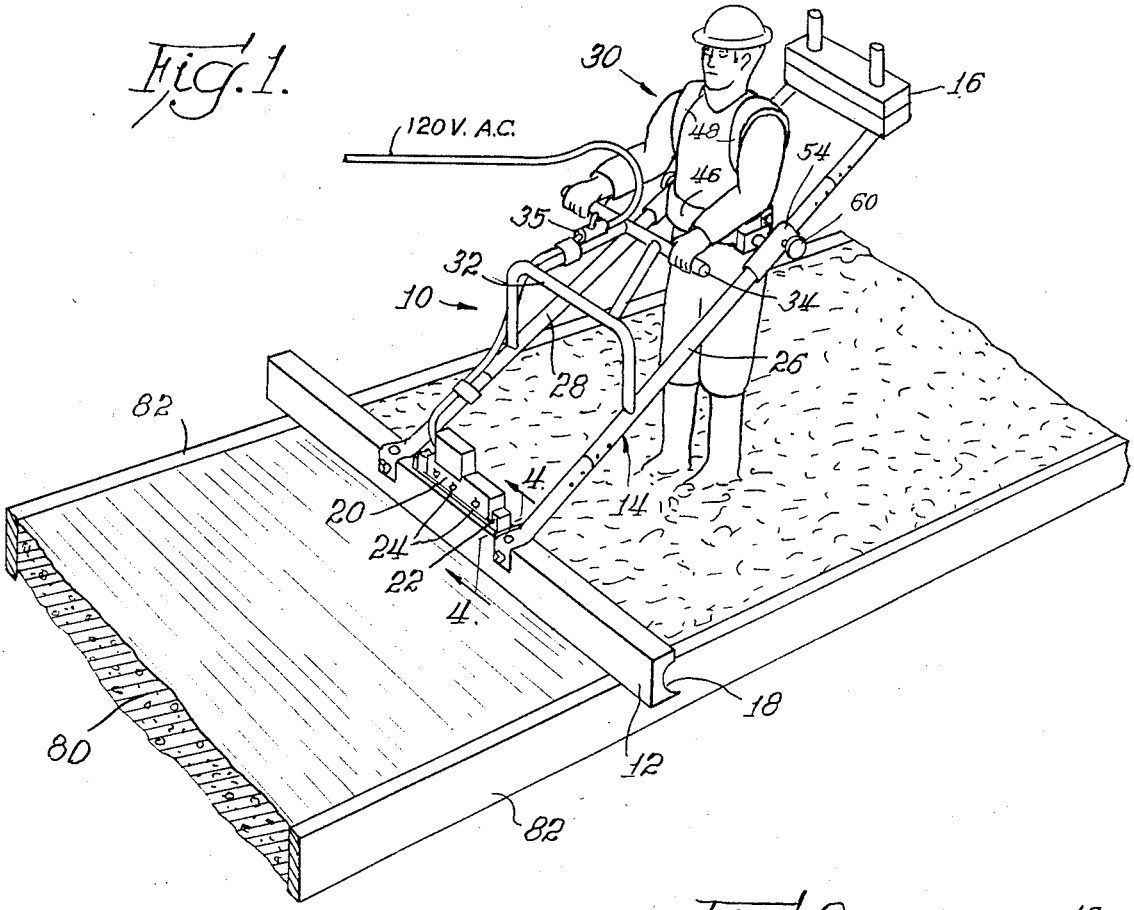
FIG. 1 is a perspective view of the portable screed according to the invention when in use.
Figure 4:
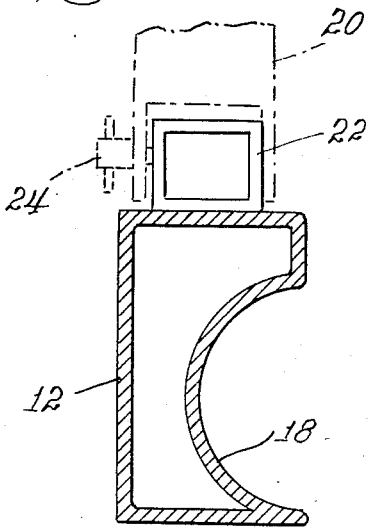
FIG. 4 is an enlarged cross-sectional view taken along lines 4—4 of FIG. 1 and illustrating the mounting of the vibrating means on the screed plate.
Figure 12:
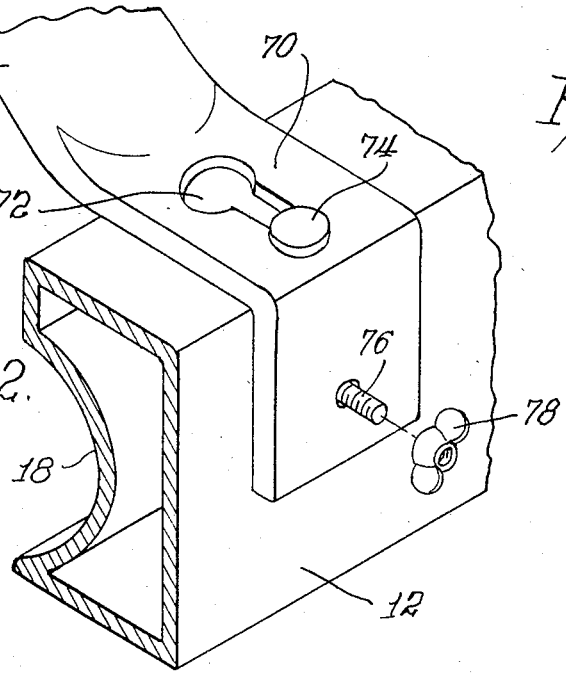
FIG. 12 is a perspective view of one means of releasably coupling the frame of the portable screed to the screed plate.

The portable screed according to the invention is shown generally at 10 in the drawing figures, and comprises three basic components, a screed plate 12, an elongated frame 14, and a balancing weight 16. The screed plate 12 is best shown in FIGS. 1, 4 and 12 and preferably includes a concave leading face 18 to aid in smoothing and leveling freshly-poured concrete. As explained in my U.S. Pat. No. 4,340,351, such a concave face permits excessive amounts of concrete to be scooped by the screed plate 12 and carried to an area which requires more concrete than that already in place. To minimize the weight of the screed plate 12, the screed plate is preferably of aluminum, magnesium, or another light-weight metal in the form of a hollow extrusion, as illustrated.

An electric vibrator 20, such as that disclosed in U.S. Pat. No. 4,359,296, is mounted at the top of the screed plate 12. If the vibrator 20 is narrower than the width of the screed plate 12, a separate mounting element 22 is secured to the top of the screed plate 12 and the vibrator 20 is secured thereto by means of a series of clamps 24.

The frame 14 is composed of a pair of spaced, parallel tubes 26 and 28 which, as best shown in FIG. 1, are separated sufficiently to accomodate an operator 30 therebetween. For the operator's convenience in controlling operation of the screed 10, a cross brace 32 extends between the tubes 26 and 28 and a handle assembly 34 is attached to the cross brace 32 at a convenient height for the operator 30. A switch 35 for the vibrator 20 may be conveniently located on the handle assembly 34 to permit the operator 30 to start and stop the vibrator 20, as desired.

Figure 11:
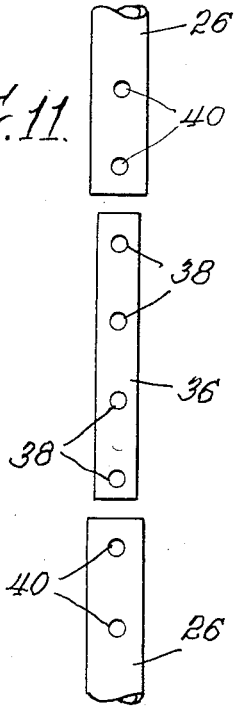
FIG. 11 is an exploded view of a means of connecting two sections of tubing of the frame of the portable screed so as to vary the length of the frame as required.

Each of the tubes 26 and 28 preferably includes at least one joint so that the length of the tube can be varied. Two joints are shown in the tube 26 in FIG. 1, and the assembly of either of the joints is shown in greater detail in FIG. 11. As seen in FIG. 11, the tube 26 is separated and a connector 36 spans the joint and includes a plurality of holes 38 which align with holes 40 in the sections of the tube 26. The connector 38 is inserted within the halves of the tube 26 and bolts (not illustrated) are inserted to securely join the tube portion 26 and the connector 36.

The weight 16 is used to balance the screed 10 so that the center of gravity of the screed is, preferably, at or just slightly forward of the center of gravity of the operator 30. This is shown schematically in FIGS. 2 and 3 for the screed 10 (FIG. 2) of a modified version of the screed 10' (FIG. 3). FIG. 3 illustrates a functionally identical screed which has a lower overall center of gravity which, under some conditions, particularly when the screed 10' is fairly heavy, can be advantageous.

Figure 2:
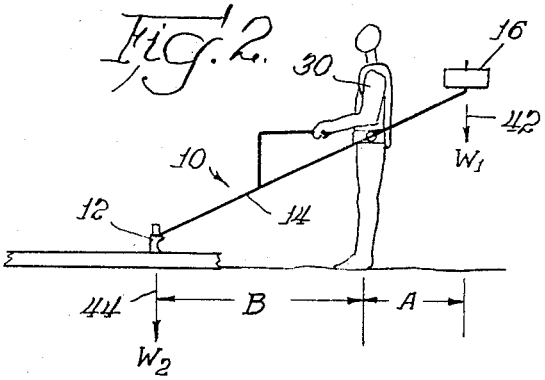
FIG. 2 is a diagrammatic view of the portable screed shown in FIG. 1 illustrating the balance of the screed at the operator.
Figure 3:
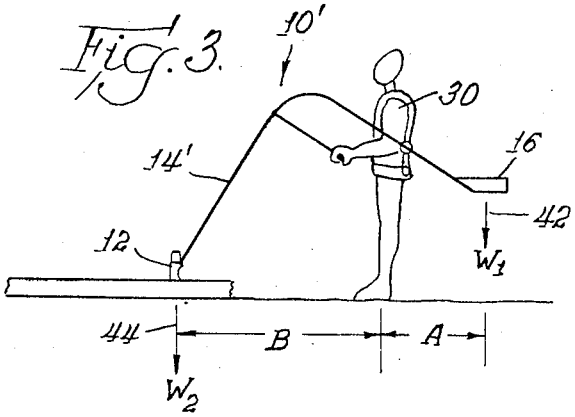
FIG. 3 is a diagrammatic view similar to FIG. 2, but showing an alternative form of the invention.

In either FIG. 2 or 3, the total weight $W_1$ of the screed aft of the operator 30 is indicated by an arrow 42. Similarly, the total weight $W_2$ of the screed forward of the operator 30 is indicated by an arrow 44. Weight $W_1$ acts at an effective distance A from the operator 30, while weight $W_2$ acts at an effective distance B from the operator 30. To balance the screed at the center of gravity of the operator 30, the following must occur:

$$W_1 \cdot A = W_2 \cdot B$$

Therefore, the simple geometrical relationship between the variables of length and weight of the screed 10 dictates the value of the weight 16.

Figure 5:
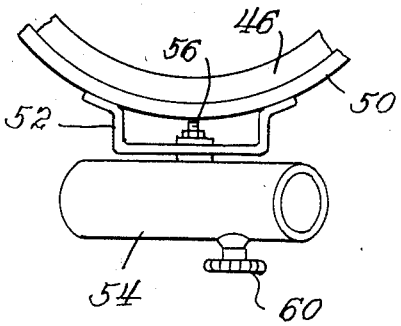
FIG. 5 is an enlarged top plan view of the mounting bracket for mounting the frame of the portable screed of FIG. 1 on a body harness.
Figure 6:
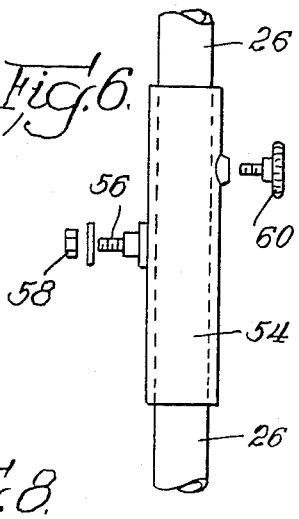
FIG. 6 is a face view of the bracket of FIG. 5 when installed on the frame of the portable screed.

The operator 30 is attached to the screed 10 by means of a harness arrangement. As best shown in FIGS. 1 and 5, the harness arrangement includes a waist belt 46 and shoulder straps 48 attached to the belt 46. A plate 50 is secured to the outer surface of the belt 46 with an outwardly-directed bracket 52 suitably attached thereto. A sleeve 54 is slidably engaged on the tube 26 (with an identical assembly on the tube 28) and a pivot pin 56, secured to the sleeve 54, extends into and is pivotal within the bracket 52. A nut 58, threadably engaged in the pivot pin 56, secures the sleeve 54 to the bracket 52, and thus the frame 14 to the operator 30. In order to provide adjustment of the location of attachment of the harness assembly (and thus, the operator 30) to the frame 14, a thumb screw 60 in engaged within the sleeve 54 and, when desired, is tightened to bear against the tube 26 to lock the sleeve 54 in place.

Figure 7:
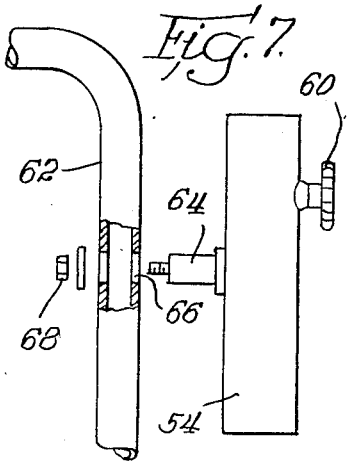
FIG. 7 is a view of the bracket of FIG. 6 when secured to a back frame of the operator in accordance with the embodiment of FIG. 3.
Figure 8:
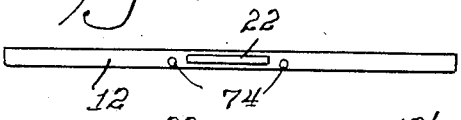
FIG. 8 is a top view of a short section of screed plate, such as that shown in FIG. 1.

In the alternative embodiment of the screed 10' of FIG. 3, the frame 14' screed 10' is shown attached not to the waist belt 46, but rather to a frame, not shown in detail, worn by the operator 30. The frame can be similar to the common pack frame, and is therefore is not described in detail. However, in FIG. 7, a frame portion 62 worn on the back of the operator 30 is shown. In this embodiment, the sleeve 54 includes a slightly modified pivot pin 64 which extends through an aperature 66 in the frame portion 62. A nut 68 is used to securely attach the sleeve 54 to the frame portion 62.

Figure 9:
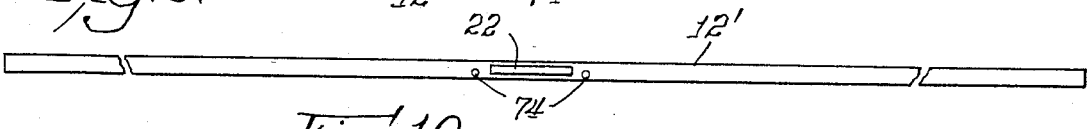
FIG. 9 is a view similar to FIG. 8 but illustrating a longer section of screed plate.

As indicated above, the screed plate 12 may vary in length, depending on the width of the ribbon of concrete to be treated. Thus, as shown schematically in FIG. 9, the screed plate 12 is of a particular length, while a longer section of screed plate 12' may similarly be provided.

In order to assure rapid connection and detachment of the frame 14 from the screed plate 12 or 12', as shown in FIG. 12, at the junction of either of the tubes 26 and 28 (26 being shown) with the screed plate 12, the tube 26 terminates in an L-shaped leg 70 having a keyway 72 formed therein. Correspondingly, an upstanding key 74, similar to a large-headed rivet, is secured in the screed plate 12. Also, a bolt 76 is secured to the face of the screed plate 12 and extends through an aligned aperture in the leg 70 when the frame 14 is engaged on the screed plate 12. A wing nut 78 locks the entire assembly in place, and, at the same time, permits rapid detachment of the frame 14 from the screed plate 12.

Figure 10:
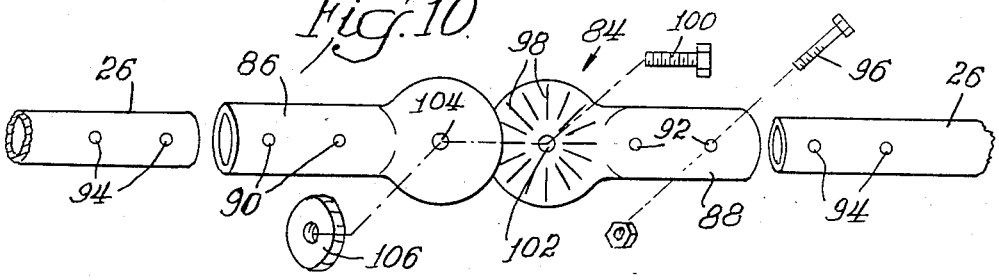
FIG. 10 is an enlarged view of a hinged joint which may be employed in the frame of the screed plate in order to vary the angle at which one portion of the frame is disposed relative to another portion of the frame.

FIG. 10 illustrates one means of providing a bend in the screed to produce the bent form of the screed 10' of FIG. 3. A hinged joint 84 is shown between portions of the tube 26. A similar joint, though not illustrated, would also be provided for the tube 28. The hinged joint 84 includes identical joint halves 86 and 88 each of which is sized to slip over a portion of the tube 26. Holes 90 and 92 are provided in the respective joint halves 86 and 88 and corresponding holes 94 are provided in the corresponding portions of the tube 26 so that a series of bolts 96 (one shown) may secure the joint 84 to the tube 26. Each joint half 86 and 88 includes a face having radial grooves 98 which face one another and interengage when drawn together by a bolt 100 passing through holes 102 and 104 and tightened by a thumb nut 106. Thus, any desired angle may be set between the portions of the tube 26, and that angle is maintained when the thumb nut 106 is tightened.

As shown in FIG. 1, the screed 10 is most advantageously employed for smoothing ribbons of concrete of substantially the same width as that of the particular screed plate 12 employed. Concrete 80 is poured between forms 82 and the screed plate 12 is rested on the tops of the forms 82. The operator 30, carrying the screed 10, stands in the wet concrete 80, placing the screed plate 12 on the forms 82. With the vibrator 20 in operation, the operator 30 moves rearwardly, leaving a smooth ribbon of concrete in his path.

The screed 10 is therefore a substantial improvement over the prior art method of smoothing a ribbon of concrete by employing two individuals who stoop or kneel on opposite sides of the concrete 80 and manually smooth the concrete in a laborious procedure requiring substantially more time than that of the present invention. Various changes can be made to the invention without departing from the spirit thereof or scope of the following claims.

What is claimed is:

1. A portable screed for working concrete as the screed is moved across the concrete, the screed being configured to be mounted on and piloted by a human being, comprising a. a screed plate for working concrete, b. means to impart vibrations to the screed plate for tamping and leveling the concrete, c. an elongated frame connected to one end to said screed plate, d. a body harness, e. means connecting said harness to said frame intermediate the ends thereof, and f. balancing means connected to said frame for positioning the center of gravity of said screed at the vicinity of the connection of said harness to said frame, said balancing means including a weight attached to said frame adjacent the end thereof opposite to said screed plate such that said weight counterbalances said screed to thereby so position said center of gravity.

2. A portable screed according to claim 1 in which said means to impart vibrations comprises a vibrator secured to said screed plate.

3. A portable screed according to claim 1 in which said frame comprises a pair of spaced, parallel tubes connected at one end to said screed plate.

4. A portable screed according to claim 3 including a cross brace between said tubes and an operator's handle connected to said cross brace.

5. A portable screed according to claim 4 including switch means on said handle for controlling said means to impart vibrations.

6. A portable screed according to claim 3 including means to adjust the length of said tubes.

7. A portable screed according to claim 6 in which said means to adjust comprises a joint in each said tube, a connector spanning said joint and having a plurality of attachment positions, and means for securing said connector to said tube at said joint.

8. A portable screed according to claim 1 in which said body harness includes a waist belt and said connecting means includes a pivot pin between said waist belt and said frame.

9. A portable screed according to claim 8 including a pair of shoulder straps connected to said waist belt.

10. A portable screed according to claim 8 in which said frame comprises a pair of spaced, parallel tubes and said connecting means includes a sleeve mounted on and slideable upon each tube, and including a pair of said pivot pins, one said pin being affixed to each said sleeve.

11. A portable screed according to claim 10 including means releaseably securing each sleeve to each tube.

12. A portable screed according to claim 1 including a hinged joint in said frame to permit one portion of said frame to be disposed at an angle relative to another portion of said frame, said joint including means to lock said joint.

13. A portable screed according to claim 1 including means releasably connecting said frame to said screed plate.

14. A portable screed according to claim 13 in which said releasable connecting means comprises a keyway in said frame and a corresponding key on said screed plate, and including means to clamp said frame to said screed plate when said key is engaged in said keyway.

15. A portable screed according to claim 1 in which said harness includes a vertical support structure and shoulder straps for mounting said support structure on a user, and in which said connecting means includes a pivot pin extending between said support structure and said frame.

16. A portable screed for working concrete as the screed is moved across the concrete, the screed being configured to be mounted on and piloted by a human being, comprising a. a screed plate for working concrete, b. means to impart vibrations to the screed plate for tamping and leveling the concrete, c. an elongated frame connected at one end to said screed plate, said frame comprising a pair of spaced tubes and a cross brace between said tubes, d. a body harness comprising a waist belt, e. means connecting said harness to said frame intermediate the ends thereof, said connecting means comprising a sleeve slideably mounted on each said tube and a pivot pin affixed to each said sleeve and secured to said belt, and f. balancing means connected to said frame for positioning the center of gravity of said screed at the vicinity of the connection of said harness to said frame, said balancing means including a weight attached to said frame adjacent the end thereof opposite to said screed plate such that said weight counterbalances said screed to thereby so position said center of gravity.

* * * * *